US006021763A

United States Patent [19]

Yoshihara et al.

[11] Patent Number: 6,021,763

[45] Date of Patent: Feb. 8, 2000

[54] FUEL SUPPLY APPARATUS FOR A DIRECT INJECTION GASOLINE INTERNAL COMBUSTION ENGINE

[75] Inventors: Fumihiro Yoshihara; Toru Kitayama, both of Atsugi, Japan

[73] Assignee: Unisia Jecs Corporation, Kanagawa-ken, Japan

[21] Appl. No.: 08/953,756

[22] Filed: Oct. 17, 1997

[30] Foreign Application Priority Data

Oct. 17, 1996 [JP] Japan ..... 8-275049

[51] Int. Cl.[7] ..... F02M 37/04

[52] U.S. Cl. ..... 123/516; 123/456; 123/179.17

[58] Field of Search ..... 123/458, 179.17, 123/516, 514, 456

[56] References Cited

U.S. PATENT DOCUMENTS

| | | | |
|---|---|---|---|
| 5,074,272 | 12/1991 | Bostick | 123/516 |
| 5,327,872 | 7/1994 | Morikawa | 123/179.17 |
| 5,394,844 | 3/1995 | Akimoto | 123/179.17 |
| 5,558,068 | 9/1996 | Kunishima | 123/516 |
| 5,598,817 | 2/1997 | Igarashi | 123/516 |
| 5,758,622 | 6/1998 | Rembold | 123/516 |
| 5,794,586 | 8/1998 | Oda | 123/179.17 |

FOREIGN PATENT DOCUMENTS

| | | | |
|---|---|---|---|
| 0 643 219 A1 | 3/1995 | European Pat. Off. . | |
| 195 39 885 A1 | 11/1996 | Germany . | |
| 0200663 | 12/1982 | Japan | 123/516 |
| 0048768 | 3/1983 | Japan | 123/516 |
| 07077119A | 3/1995 | Japan . | |
| 2 271 810 | 4/1994 | United Kingdom . | |

*Primary Examiner*—Carl S. Miller
*Attorney, Agent, or Firm*—McDermott, Will & Emery

[57] ABSTRACT

At the time of low temperature start up of a direct injection gasoline engine internal combustion engine, a pressure adjustment function of a low pressure pressure regulator is stopped, so that all of the fuel pumped from a low pressure fuel pump is supplied to a high pressure fuel pump. Moreover, the fuel from a high pressure fuel system is returned directly to a fuel tank. Hence vapor produced while the engine is stopped is discharged together with the fuel.

4 Claims, 4 Drawing Sheets

FUEL SUPPLY APPARATUS FOR A DIRECT INJECTION GASOLINE INTERNAL COMBUSTION ENGINE

BACKGROUND OF THE INVENTION

1. Field of the Invention

The present invention relates to a fuel supply apparatus for a direct injection gasoline internal combustion engine. In particular the invention relates to techniques with a direct injection gasoline internal combustion engine having direct injection of fuel into the combustion chamber, for managing at start up, air and fuel vapor which have mixed in the fuel piping when the engine is stopped.

2. Related Art of the Invention

Heretofore there is known a fuel supply apparatus for a direct injection gasoline internal combustion engine, which comprises; a fuel injection valve for injecting fuel directly into the combustion chamber, a high pressure fuel pump for supplying fuel to the fuel injection valve, a low pressure fuel pump for supplying fuel to the high pressure fuel pump, a low pressure pressure regulator for adjusting the pressure in a low pressure fuel system between the low pressure fuel pump and the high pressure fuel pump to a predetermined low pressure, and a high pressure pressure regulator for adjusting the pressure in a high pressure fuel system downstream of the high pressure fuel pump to a predetermined high pressure.

Furthermore, with the fuel supply apparatus for a direct injection gasoline internal combustion engine constructed as described above, as a method for discharging the fuel vapor and air inside the fuel piping to ensure startability, there is an arrangement as disclosed in Japanese Unexamined Patent Publication No. 7-77119.

With the method disclosed in the above publication, a branch path which bypasses the high pressure pressure regulator is provided for returning fuel which has been supplied from the high pressure fuel pump directly to the fuel tank, and an open/close valve is disposed in the branch path so that by opening the open/close valve at the time of start up, fuel in the high pressure fuel piping is discharged together with vapor.

With the abovementioned conventional method however, the construction is such that the pressure adjustment by the low pressure pressure regulator is normally carried out also when the fuel in the high pressure fuel system is being returned directly to the fuel tank. Therefore, the fuel which is returned to the fuel tank from the low pressure pressure regulator of the fuel which is pumped from the low pressure fuel pump does not contribute to the expulsion of fuel in the high pressure fuel system. As a result, there is the problem that the fuel in the high pressure fuel system cannot be discharged with good efficiency.

Furthermore, with the conventional method, when the open/close valve is opened so that the fuel is returned directly to the fuel tank from the high pressure fuel system, then since pressure adjustment in the high pressure fuel system is not carried out at all, the fuel pressure changes so that the injection quantity becomes unstable, with the problem that controllability of the air/fuel ratio at the time of start up is compromised.

SUMMARY OF THE INVENTION

The present invention takes into consideration the above problems, with the object of being able to efficiently discharge the fuel in the high pressure fuel system.

Moreover it is an object of the invention to be able to stabilize the fuel injection quantity at the time of start up while carrying out discharge of vapor in the high pressure fuel system.

In order to achieve the above objects, the fuel supply apparatus for a direct injection gasoline internal combustion engine according to the present invention comprises: a fuel injection valve for injecting fuel directly into a combustion chamber of an engine, a high pressure fuel pump for supplying fuel to the fuel injection valve, a low pressure fuel pump for supplying fuel to the high pressure fuel pump, a low pressure pressure regulator for adjusting the pressure in a low pressure fuel system between the low pressure fuel pump and the high pressure fuel pump to a predetermined low pressure, and a high pressure pressure regulator for adjusting the pressure in a high pressure fuel system downstream of the high pressure fuel pump to a predetermined high pressure. Moreover there is provided a vapor management device for stopping, at the time of engine start up, a pressure adjustment function of the low pressure pressure regulator, and returning fuel from the high pressure fuel system directly to a fuel tank.

With such a construction, by stopping the pressure adjustment function of the low pressure pressure regulator at the time of engine start up, the fuel is no longer returned to the fuel tank from the low pressure pressure regulator, so that all of the fuel pumped from the low pressure fuel pump is supplied to the high pressure fuel pump. Moreover, the fuel in the high pressure fuel system is returned directly to the fuel tank, and hence the vapor produced while the engine is stopped is discharged together with fuel to the fuel tank.

Here the vapor management device may stop the pressure adjustment function of the low pressure pressure regulator, and return the fuel from the high pressure fuel system directly to the fuel tank, over a time from when a start switch is switched on until lapse of a predetermined time.

With such a construction, then during the predetermined time from when the start switch is switched on, the pressure adjustment by the low pressure pressure regulator is stopped, and vapor discharge is carried out by returning the fuel directly to the fuel tank from the high pressure fuel system. Then after the predetermined time has elapsed, the pressure of the low pressure fuel system is adjusted by the low pressure pressure regulator, and only fuel which becomes surplus as a result of the pressure adjustment by the high pressure pressure regulator, is returned to the fuel tank from the high pressure fuel system.

Moreover, the construction may be such that the vapor management device comprises: a vapor management valve for selectively opening a path for returning fuel directly to the fuel tank from the high pressure fuel system, a cutoff valve for selectively cutting off the inflow of fuel to the low pressure pressure regulator, and a valve control device for opening the vapor management valve, and closing the cutoff valve at the time of engine start up.

With such a construction, when the cutoff valve is closed, the inflow of fuel to the low pressure pressure regulator is cut off so that the pressure adjustment function of the low pressure pressure regulator is stopped. Moreover, when the vapor management valve is opened, the path for returning the fuel in the high pressure fuel system directly to the fuel tank is opened so that fuel in the high pressure fuel system returns to the fuel tank.

The construction may be such that in the case where the vapor management valve and the cutoff valve are provided, the vapor management valve is a normally closed type valve and the cutoff valve is a normally open type valve.

With such a construction the pressure of the low pressure fuel system and the high pressure fuel system is normally adjusted in a non powered condition of the respective valves. Hence there is no loss of pressure adjustment due to a disconnection or the like in the power supply circuit.

Moreover, the fuel supply apparatus for a direct injection gasoline internal combustion engine according to another aspect of the present invention comprises: a fuel injection valve for injecting fuel directly into a combustion chamber of an engine, a high pressure fuel pump for supplying fuel to the fuel injection valve, a low pressure fuel pump for supplying fuel to the high pressure fuel pump, a low pressure pressure regulator for adjusting the pressure in a low pressure fuel system between the low pressure fuel pump and the high pressure fuel pump to a predetermined low pressure, and a high pressure pressure regulator for adjusting the pressure in a high pressure fuel system downstream of the high pressure fuel pump to a predetermined high pressure. Moreover there is provided a low pressure management device for stopping, at the time of engine start up, the pressure adjustment of the low pressure fuel system by the low pressure pressure regulator, and carrying out the pressure adjustment of the high pressure fuel system by the low pressure pressure regulator.

With such a construction, since at the time of engine start up, the pressure adjustment of the low pressure fuel system by the low pressure pressure regulator is stopped, fuel is not returned to the fuel tank from the low pressure fuel system, so that all of the fuel pumped from the low pressure fuel pump is supplied to the high pressure fuel pump. Moreover, by adjusting the pressure in the high pressure fuel system by the low pressure pressure regulator, then the fuel quantity returning to the fuel tank from the high pressure fuel system is greater than when adjusted by the high pressure pressure regulator. The vapor generated while the engine is stopped is thus discharged, and the pressure of the high pressure fuel system is adjusted to a set pressure of the low pressure pressure regulator.

Here the low pressure management device may stop the pressure adjustment of the low pressure fuel system by the low pressure pressure regulator and carry out the pressure adjustment of the high pressure fuel system by the low pressure pressure regulator, over a time from when a start switch is switched on until lapse of a predetermined time.

With such a construction, then during the predetermined time from when the start switch is switched on, the low pressure pressure regulator adjusts the pressure of the high pressure fuel system rather than that of the low pressure fuel system. Then after the predetermined time has elapsed, conditions return to normal with the low pressure pressure regulator adjusting the pressure of the low pressure fuel system, and the high pressure pressure regulator adjusting the pressure of the high pressure fuel system.

Moreover the construction may be such that the low pressure management device comprises: a low pressure switching valve for selectively opening a path which supplies fuel in the high pressure fuel system as fuel used in pressure adjustment to the low pressure pressure regulator, a cutoff valve for selectively cutting off the inflow of fuel from the low pressure fuel system to the low pressure pressure regulator, and a valve control device for opening the low pressure switching valve and closing the cutoff valve at the time of engine start up.

With such a construction, when the cutoff valve is closed, the inflow of fuel from the low pressure fuel system to the low pressure pressure regulator is cut off. Hence, as a result of pressure adjustment of the low pressure fuel system, the fuel in the low pressure system is not returned to the fuel tank. Furthermore, when the low pressure switching valve is opened, the fuel in the high pressure fuel system is supplied to the low pressure pressure regulator. Hence the pressure of the high pressure fuel system is adjusted by the low pressure pressure regulator, and surplus fuel for adjusting the pressure of the high pressure fuel system to the set pressure of the low pressure pressure regulator is returned from the high pressure fuel system to the fuel tank.

The construction may be such that in the case where the low pressure switching valve and cutoff valve are provided, the low pressure switching valve is a normally closed type valve, and the cutoff valve is a normally open type valve.

With such a construction the pressure of the low pressure fuel system and the high pressure fuel system is normally adjusted in a non powered condition of the respective valves. Hence there is no loss of pressure adjustment due to a disconnection or the like in the power supply circuit.

Other objects and aspects of the present invention will become apparent from the following description of embodiments, given in conjunction with the appended drawings.

DESCRIPTION OF THE PREFERRED EMBODIMENTS

As follows is a description of embodiments of the present invention.

Figure 1:
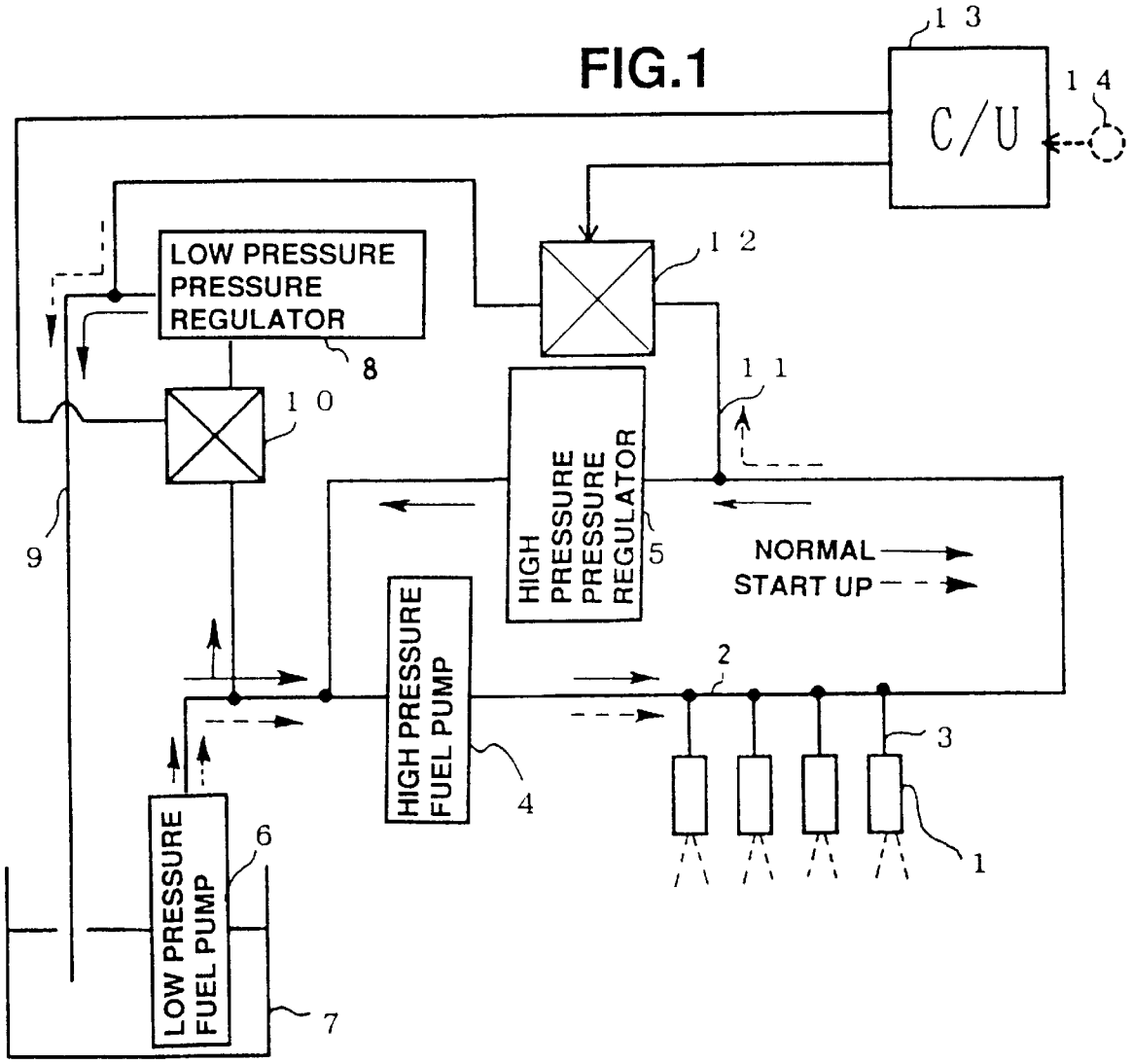
FIG. 1 is a system configuration diagram of a fuel supply apparatus according to a first embodiment.

FIG. 1 is a system configuration diagram showing a fuel supply apparatus for a direct injection gasoline internal combustion engine, according to a first embodiment.

In FIG. 1, fuel injection valves 1 are provided facing the combustion chambers of respective cylinders of a direct injection gasoline internal combustion engine (not shown in the figure), for injecting fuel directly into the combustion chamber.

Fuel is distributed and supplied to the respective fuel injection valves 1 from a common rail 2 via distribution pipes 3. The fuel is supplied under pressure to the common rail 2 from an engine driven high pressure fuel pump 4.

A high pressure pressure regulator 5 is provided downstream of the common rail 2, for adjusting the fuel pressure in a high pressure fuel system between the high pressure fuel pump 4 and the high pressure pressure regulator 5, to a predetermined high pressure. The high pressure pressure regulator 5 adjusts the actual fuel pressure to a predetermined high pressure by returning the fuel in the high pressure fuel system to the intake side of the high pressure fuel pump 4 when the actual fuel pressure is higher than the predetermined high pressure.

On the supply side, fuel which is drawn up from a fuel tank 7 by means of a low pressure electric fuel pump 6 is adjusted to a predetermined low pressure by means of a low pressure pressure regulator 8 and then supplied to the high pressure fuel pump 4.

The low pressure pressure regulator 8 adjusts the actual fuel pressure to a predetermined low pressure by returning the fuel in a low pressure fuel system between the low pressure fuel pump 6 and the high pressure fuel pump 4 to the fuel tank 7 via a return path 9, when the pressure of the fuel supplied to the high pressure fuel pump 4 is higher than the predetermined low pressure.

Moreover, as a characteristic construction, a cutoff valve 10 is disposed in a path for introducing fuel to the low pressure pressure regulator 8 from the low pressure fuel system between the low pressure fuel pump 6 and the high pressure fuel pump 4. Furthermore, a vapor management valve 12 is disposed in a branch path 11 communicating with the return path 9, which branches from a branch point downstream of the fuel injection valves 1 and upstream of the high pressure pressure regulator 5.

The cutoff valve 10 and the vapor management valve 12 are both solenoid valves. The cutoff valve 10 is a normally open type valve while the vapor management valve 12 is a normally closed type valve. These valves 10, 12 are selectively opened and closed by electrical control of a control unit 13 incorporating a microcomputer.

A signal from a start switch 14 is input to the control unit 13 which serves as a valve control device, controlling the cutoff valve 10 to close and the vapor management valve 12 to open, during a predetermined time from switching on the start switch 14.

Figure 2:
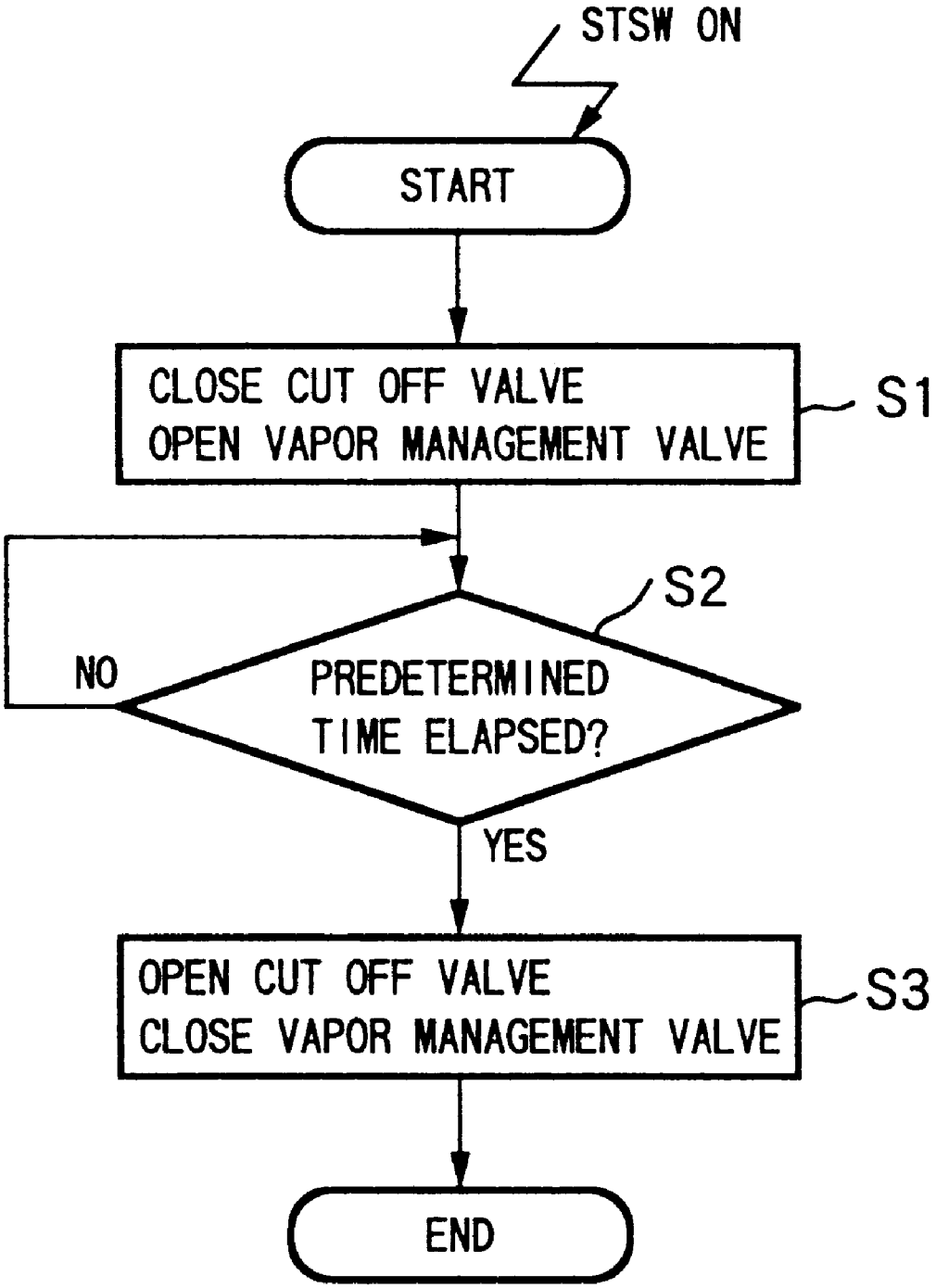
FIG. 2 is a flow chart illustrating an aspect of the control of the fuel supply system of the first embodiment.

Aspects of the valve control by the control unit 13 are illustrated in the flow chart of FIG. 2.

The routine shown in the flow chart of FIG. 2 is interruptingly executed when the start switch 14 is switched on. At first, in step 1, the cutoff valve 10 is controlled to close and the vapor management valve 12 is controlled to open.

Then in step 2, it is judged if a predetermined time has elapsed from switching on the start switch 14. Control waits until the predetermined time has elapsed.

When the predetermined time has elapsed, control proceeds to step 3 where the cutoff valve 10 is controlled to open, and the vapor management valve 12 is controlled to close, thus returning to the condition where the fuel pressure is normally adjusted by the respective pressure regulators 5 and 8, and the routine is then terminated.

When the cutoff valve 10 is controlled to close, all of the fuel pumped from the low pressure fuel pump 6 is supplied to the high pressure fuel pump 4. Furthermore, when the vapor management valve 12 is controlled to open, the function of adjusting the high pressure fuel system to a predetermined high pressure by means of the high pressure pressure regulator 5 is deactivated, so that fuel inside the high pressure fuel system is discharged to the fuel tank 7, and the air and fuel vapor included in the high pressure fuel system are discharged together with the fuel to the fuel tank (vapor management device).

When the cutoff valve 10 is not provided, then of the fuel which is pumped from the low pressure fuel pump 6 the surplus portion when the low pressure fuel system is adjusted to the predetermined low pressure, is returned to the fuel tank by means of the low pressure pressure regulator 8, via the return path 9. Therefore the fuel returned to the fuel tank from the low pressure pressure regulator 8 does not contribute to the expulsion of fuel in the high pressure fuel system.

In contrast to this, if as with the first embodiment, the pressure adjustment function by the low pressure pressure regulator 8 is stopped by the cutoff valve 10, then all of the fuel pumped from the low pressure fuel pump 6 can be used for expulsion of the fuel in the high pressure fuel system. The fuel which has remained in the high pressure fuel system can thus be expelled in the short time immediately after start up and control then moved to normal control conditions (cutoff valve 10 open and vapor management valve 12 closed).

Figure 3:
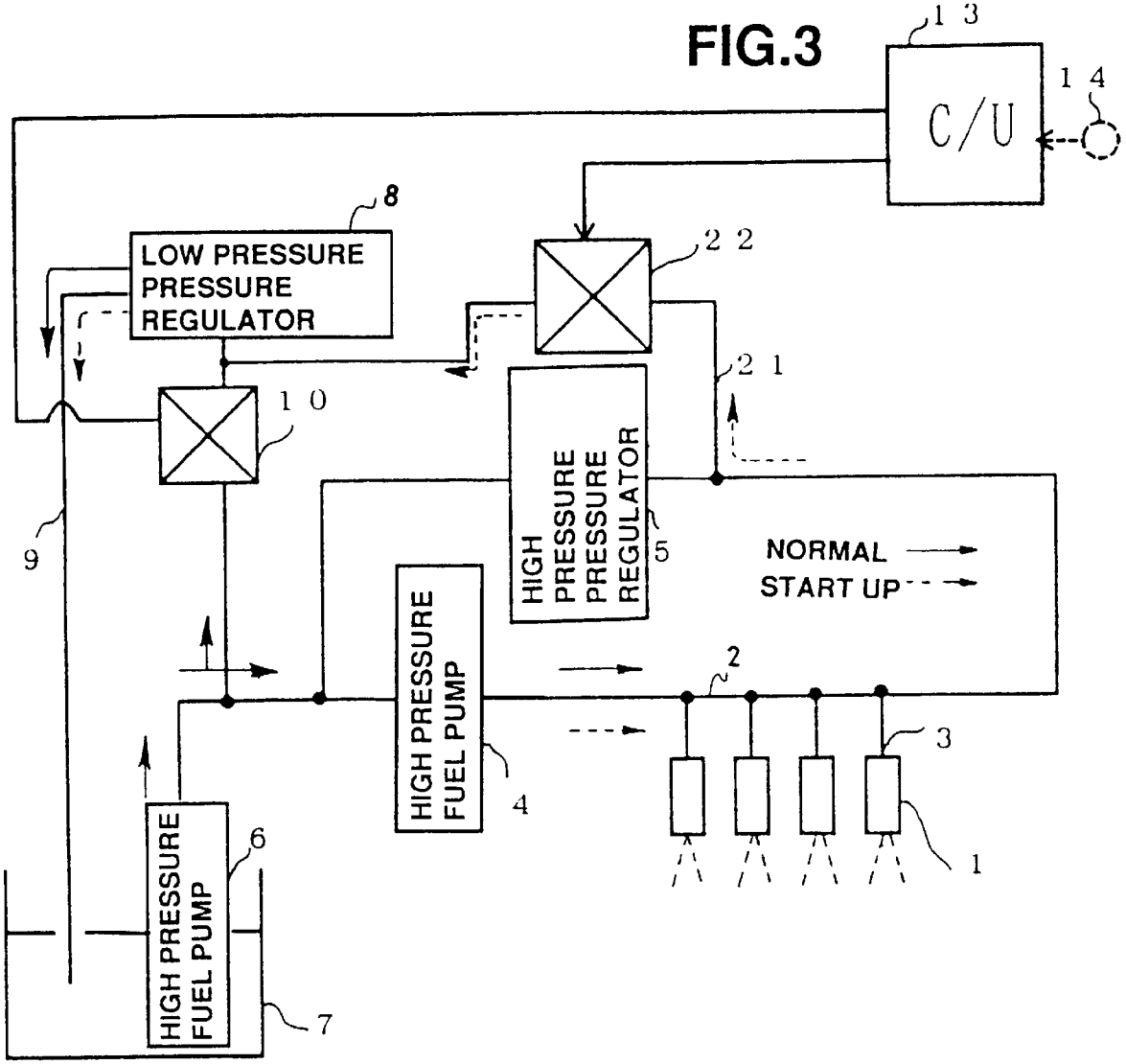
FIG. 3 is a system configuration diagram of a fuel supply apparatus according to a second embodiment.

In FIG. 1, and in FIG. 3 to be described hereunder, the flow of the fuel at normal times is indicated by full line arrows, while the flow of fuel when discharge of fuel from the high pressure fuel system is being carried out at the time of start up is indicated by dotted line arrows.

FIG. 3 is a system configuration diagram of a second embodiment. Components the same as in FIG. 1 are indicated by the same symbols and description is omitted.

With the second embodiment shown in FIG. 3, a branch path 21 branching from a branch point downstream of fuel injection valves 1 and upstream of a high pressure pressure regulator 5, is connected to the pressure introducing side of a low pressure pressure regulator 8. A normally closed type low pressure switching valve 22 is disposed in the branch path 21.

A control unit 13 which serves as a valve control device, controls a cutoff valve 10 to close and controls the low pressure switching valve 22 to open, during a predetermined time from switching on a start switch 14.

Figure 4:
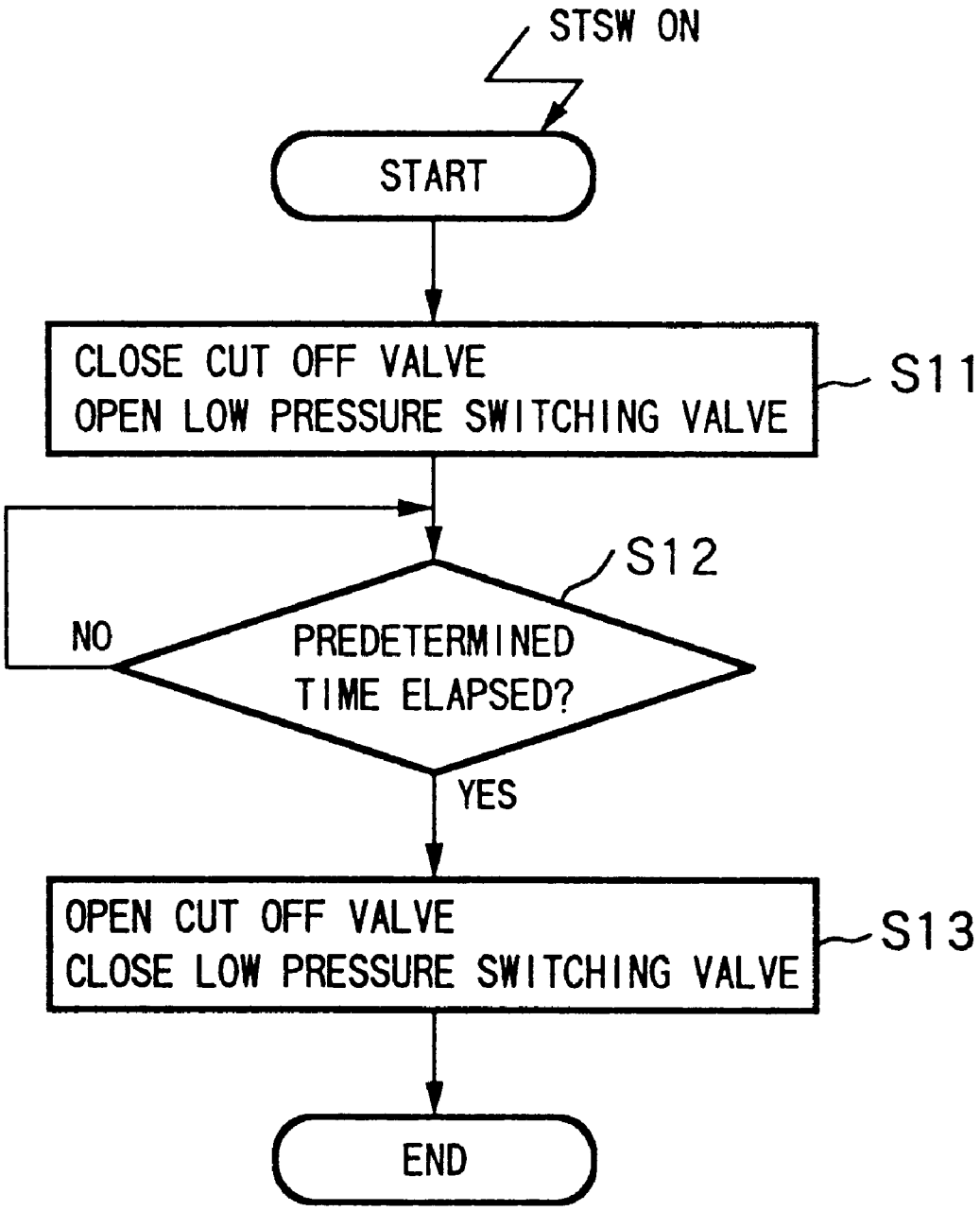
FIG. 4 is a is a flow chart illustrating an aspect of the control of the fuel supply system of the second embodiment.

Aspects of the valve control by the control unit 13 are illustrated in the flow chart of FIG. 4.

The routine shown in the flow chart of FIG. 4 is interruptingly executed when the start switch 14 is switched on. At first, in step 11, the cutoff valve 10 is controlled to close and the low pressure switching valve 22 is controlled to open.

Then in step 12, it is judged if a predetermined time has elapsed from switching on the start switch 14. Control waits until the predetermined time has elapsed.

When the predetermined time has elapsed, control proceeds to step 13 where the cutoff valve 10 is controlled to open, and the low pressure switching valve 22 is controlled to close, thus returning to the condition where the fuel pressure is normally adjusted by the respective pressure regulators 5 and 8, and the routine is then terminated.

When the cutoff valve 10 is controlled to close, all of the fuel pumped from the low pressure fuel pump 6 is supplied to the high pressure fuel pump 4. Furthermore, when the low pressure switching valve 22 is controlled to open, this results in adjustment of the pressure of the high pressure fuel system to a predetermined low pressure by means of the low pressure pressure regulator 8 (low pressure management device).

Consequently, as with the first embodiment, when expulsion of the fuel accumulated in the high pressure fuel system is carried out, it is possible to avoid the occurrence of fuel being returned to the fuel tank before being supplied to the high pressure fuel pump 4. Moreover, by adjusting the pressure of the high pressure fuel system using the low pressure pressure regulator 8, then the amount of fuel returned to the fuel tank from the high pressure fuel system can be kept large, thus enabling positive discharge of fuel remaining in the high pressure fuel system. Furthermore, the pressure of the fuel in the high pressure fuel system is kept stable at a predetermined low pressure and hence the quantity of the fuel injected by the fuel injection valves 1 can be controlled with good accuracy.

We claim:

1. A fuel supply apparatus for a direct injection gasoline internal combustion engine, said apparatus comprising:

a fuel injection valve for injecting fuel directly into a combustion chamber of an engine;

a high pressure fuel pump for supplying fuel to said fuel injection valve;

a low pressure fuel pump for supplying fuel to said high pressure fuel pump;

a low pressure pressure regulator for adjusting the pressure in a low pressure fuel system between said low pressure fuel pump and said high pressure fuel pump to a predetermined low pressure;

a high pressure pressure regulator for adjusting the pressure in a high pressure fuel system downstream of said high pressure fuel pump to a predetermined high pressure; and vapor management means for stopping, at the time of engine start up, a pressure adjustment function of the low pressure pressure regulator, supplying all fuel discharged from said low pressure fuel pump to said high pressure fuel pump, and returning fuel of said high pressure fuel system by bypassing said high pressure pressure regulator.

2. The fuel supply apparatus for a direct injection gasoline internal combustion engine according to claim 1, wherein said vapor management means stops the pressure adjustment function of said low pressure pressure regulator, supplies all fuel discharged from said low pressure fuel pump to said high pressure fuel pump, and returns fuel of said high pressure fuel system by bypassing said high pressure pressure regulator, over a time from when a start switch is switched on until lapse of a predetermined time.

3. The fuel supply apparatus for a direct injection gasoline internal combustion engine according to claim 1, wherein said vapor management means comprises:

vapor management valve for selectively opening a path for returning fuel of the high pressure fuel system to said fuel tank by bypassing said high pressure pressure regulator;

a cutoff valve for selectively cutting off the inflow of fuel to said low pressure pressure regulator; and valve control means for opening said vapor management valve, and closing said cutoff valve at the time of engine start up.

4. The fuel supply apparatus for a direct injection gasoline internal combustion engine according to claim 3, wherein said vapor management valve is normally a closed type valve and said cutoff valve is a normally open type valve.

* * * * *